United States Patent [19]

Warkentin et al.

[11] 4,203,274

[45] May 20, 1980

[54] APPARATUS FOR PACKING ARTICLES OF FRUIT INTO BOXES

[75] Inventors: Aaron J. Warkentin, Orange Cove; Jacob Hiebert, Reedley, both of Calif.

[73] Assignee: Pennwalt Corporation, Philadelphia, Pa.

[21] Appl. No.: 858,821

[22] Filed: Dec. 8, 1977

[51] Int. Cl.[2] ..... B65B 35/30

[52] U.S. Cl. ..... 53/537; 53/543; 53/244; 53/251

[58] Field of Search ..... 53/161, 164, 165, 237, 53/240, 244, 247, 249, 251; 214/1 BB, 1 BD, 1 BT, 1 BV

[56] References Cited

U.S. PATENT DOCUMENTS

| | | | |
|---|---|---|---|
| 2,179,648 | 11/1939 | Thayer | 53/251 X |
| 2,249,201 | 7/1941 | Ferguson | 214/1 BV |

*Primary Examiner*—Travis S. McGehee

[57] ABSTRACT

Articles of fruit are fed to a receiving head, positioned in a predetermined pattern for packing, transferred in that pattern to a transfer rack which advances toward and pivots into a container to be loaded, and deposits the fruit in the same pattern. Apparatus for pivoting the transfer rack as it advances toward the container includes rotational members connected by a chain. Additional articles of fruit in a different pattern are deposited as a second layer by means of adjacent duplicate apparatus.

17 Claims, 10 Drawing Figures

APPARATUS FOR PACKING ARTICLES OF FRUIT INTO BOXES

BACKGROUND OF THE INVENTION

This invention relates to equipment for automatically packing articles of fruit into containers such as packing boxes. More specifically, this invention is directed to an automated apparatus for packing fruit into containers in predetermined patterns.

Certain fruits, such as melons, must be securely packed in shipping containers to prevent damage during transit and handling. To achieve this result, the articles of fruit are snugly packed in predetermined patterns. Typically, staggered or alternating patterns are used. For example, a shipping box could contain two layers of melons with each layer having nine melons. The bottom layer would consist of three rows of three melons each with the center row offset so that the melons in the center row fit snugly against the melons in the side rows in a staggered pattern. The side rows, in turn, fit snugly against the sides of the box holding the layer of melons securely in place. A second layer of melons could be packed in a complementary staggered pattern so that the melons in the second layer would fit snugly against each other and the melons in the first layer. Additional alternating staggered layers of melons could be added depending upon how many melons are to be packed in a box.

An additional advantage of packing melons in this manner is that using staggered alternating layers enables more melons to be packed in a container than could be packed if random packing patterns are used.

Packing fruit in this manner by hand is expensive. The apparatus, which is the subject of this invention, relates to a labor-saving and cost-saving automated device which packs fruit in predetermined patterns necessary to minimize damage to the fruit during transit and handling.

SUMMARY OF THE INVENTION

According to the present invention, articles of fruit are fed to a receiving head on which the fruit is arranged in a predetermined pattern such as a staggered pattern. The fruit, as arranged, is then transferred to a transfer rack which is pivotably mounted on a movable carriage. The carriage, in turn, advances toward the container to be loaded and, simultaneously, a means for pivoting the transfer rack causes the transfer rack to tilt and to deposit the layer of fruit into an open container in the pattern in which it was arranged on the receiving head. An advancing means is provided to advance containers to and from a loading station.

The means for pivoting the transfer rack consists of a first rotational member, such as an arm, which is pivotably attached to the carriage on which the transfer rack is mounted; a second rotational member, such as a sprocket, which is integrally attached to the transfer rack at the point where the transfer rack pivots on the carriage; a means for transmitting rotation from the first rotational member to the second rotational member, such as a chain; and a lever arm which is integrally attached to the first rotational member. As the carriage and transfer rack advance on rails towards the container which is to be packed, the lever arm engages a stop which causes the first rotational member to pivot. That rotation is transmitted to the second rotational member which causes the transfer rack to pivot.

Stop means are provided which stop the carriage at the point where the transfer rack is substantially parallel to the plane of the bottom of the container and in position to deposit the fruit. At this point, the rotation of the transfer rack ceases and the momentum built up causes the fruit to disengage from the transfer rack and to be deposited into the container in the pattern in which it was positioned on the receiving head.

Means for advancing containers to and from a loading station are utilized. In addition, control means are used to automatically actuate each element of the apparatus in proper sequence.

To pack multiple layers of fruit in containers, multiple fruit packing units located adjacent to each other may be utilized.

Such an apparatus will find extensive use in the packing of fruits, such as canteloupe melons, honeydew melons, muskmelon and watermelons. Using this apparatus in the packing operation will substantially reduce packing costs and, at the same time, insure that fruit will be snugly packed in containers to minimize damage during handling and transit.

A principal object of the present invention is to provide a means whereby fruit, such as melons, can be automatically packed in containers such as boxes in predetermined patterns, such as staggered layers, which will minimize damage to the fruit during transit and handling. A chute feeds fruit to a receiving head on which a layer of fruit is automatically arranged in the pattern in which it is to be packed in the container. Once arranged in the correct pattern, the fruit is transferred to a transfer rack on which the articles of fruit are maintained in that pattern. The transfer rack, in turn, is designed to pivot so that it may tilt and deposit the layer of fruit in a container in the predetermined pattern.

A second feature of the present invention is the capability of packing a plurality of layers of fruit in containers in nesting patterns. This is accomplished by positioning, adjacent to each other, a series of fruit packing units.

In accordance with this aspect of the present invention, a first layer of fruit is deposited in a container by a first transfer rack, and the container is then automatically advanced to a loading station adjacent to a second transfer rack which, in turn, deposits in the container a second layer of fruit in a pattern complementary to the pattern of the first layer. Additional layers may be packed by positioning additional units as necessary. Thus, the apparatus which is the subject of this invention is capable of packing multiple layers of fruit in complementary patterns to insure that damage to the fruit will be minimized during transit and handling.

Another object of the present invention is to provide the means for automatically pivoting the transfer rack so that it will tilt to deposit the layer of fruit which it holds into a container. In accordance with the present invention, this is achieved by a mechanism which is actuated automatically as the transfer rack, loaded with fruit, moves away from the receiving head and toward the container in which the fruit is to be loaded. The transfer rack is attached to a carriage or base and is pivotably mounted to the carriage. A first rotational member, such as an arm, is attached to the carriage. A second rotational member, which may be in the form of a pulley or sprocket, is integrally attached to the transfer rack at the point where the transfer rack pivots on the carriage. Means for transmitting rotation from the first rotational member to the second rotational member, such as a chain, is utilized to actuate the second rotational member as the first rotational member rotates. Integrally attached to the first rotational member is a lever arm which extends away from the carriage and which is actuated by stopping devices as the carriage and transfer rack move away from the receiving head. Thus, as the carriage moves toward the container which is to be loaded, the lever will engage a stop causing the first rotational member to rotate. That rotation, in turn, is transmitted to the second rotational member causing the transfer rack to pivot and tilt in order to deposit the fruit in a container. As the carriage returns to its original position, the lever is actuated by another stop causing the transfer rack to return to its original position.

In accordance with the above objects and features, an apparatus is provided which automatically packs in containers such as shipping boxes fruit such as melons in such a way that damage to the to the fruit during transit and handling will be minimized. Further objects and advantages of the invention will become apparent from the following detailed description taken in conjunction with the accompanying drawings.

DETAILED DESCRIPTION OF THE DRAWINGS

DESCRIPTION OF THE INVENTION

Figure 1:
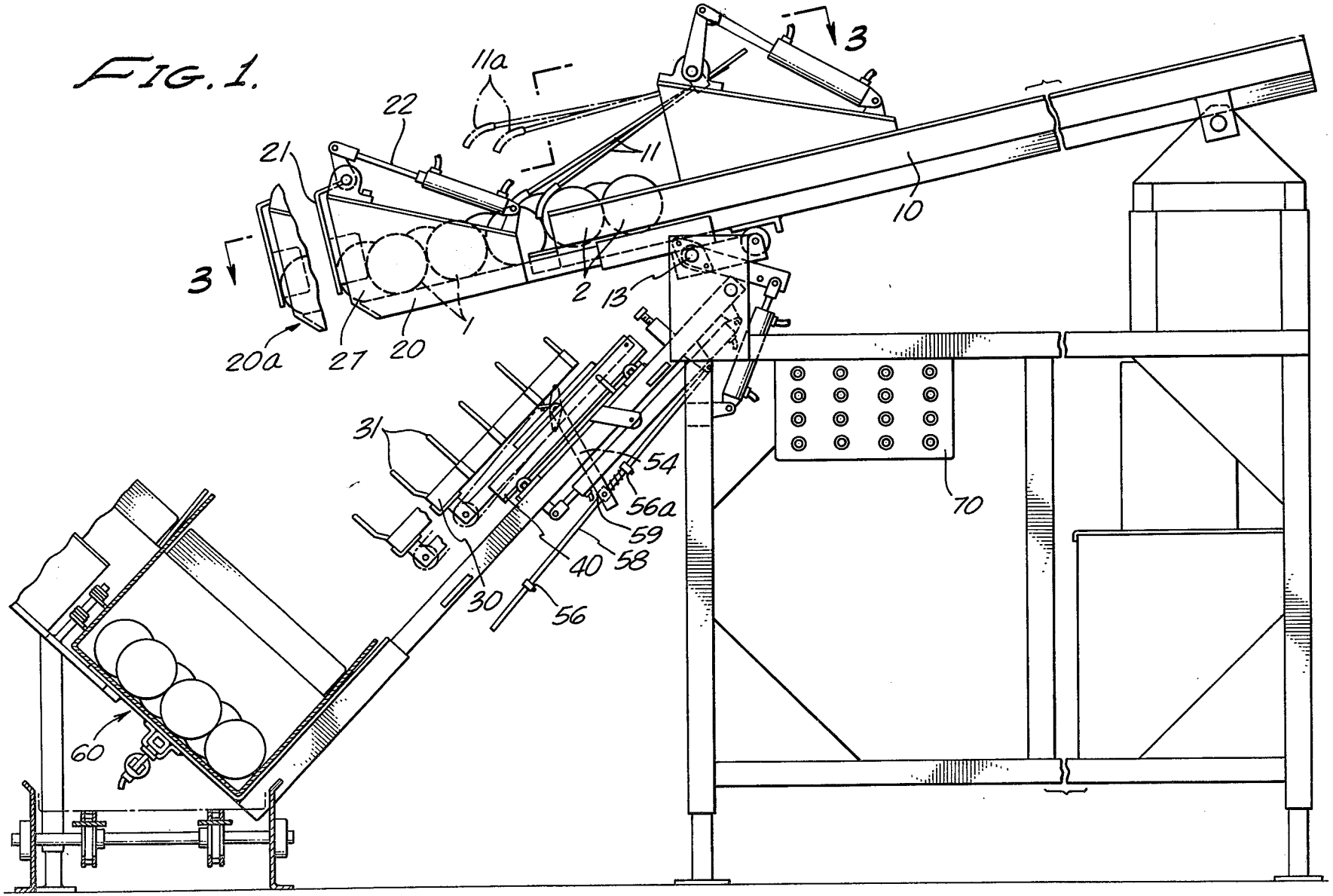
FIG. 1 is a side elevation of the fruit-packing apparatus, partly in section, showing the receiving head in its upward position with fruit loaded thereon.

Referring in detail to the drawings, the fruit-packing apparatus is shown in FIG. 1 wherein articles of fruit 1 have been fed to the receiving head 20 from the inclined chute 10 and the restraining fingers 11 for the fruit 2 on the feed chute 10 are in the down position to engage and restrain further movement of the fruit so that the receiving head 20 can swing downward about pivot 13 to engage the transfer rack 30. The phantom line position of the fingers 11 for the second chute 10*a* adjacent to chute 10 shows them in the up position. Other means, such as a gate, could be used to restrain fruit on the inclined chute 10. The gate 21 on receiving head 20 is in the down position to hold fruit in the receiving head. It is actuated by cylinder assembly 22. Receiving head 20 turns about pivot 13 which enables the receiving head 20 to be swung downward to engage transfer rack 30.

Figure 3:
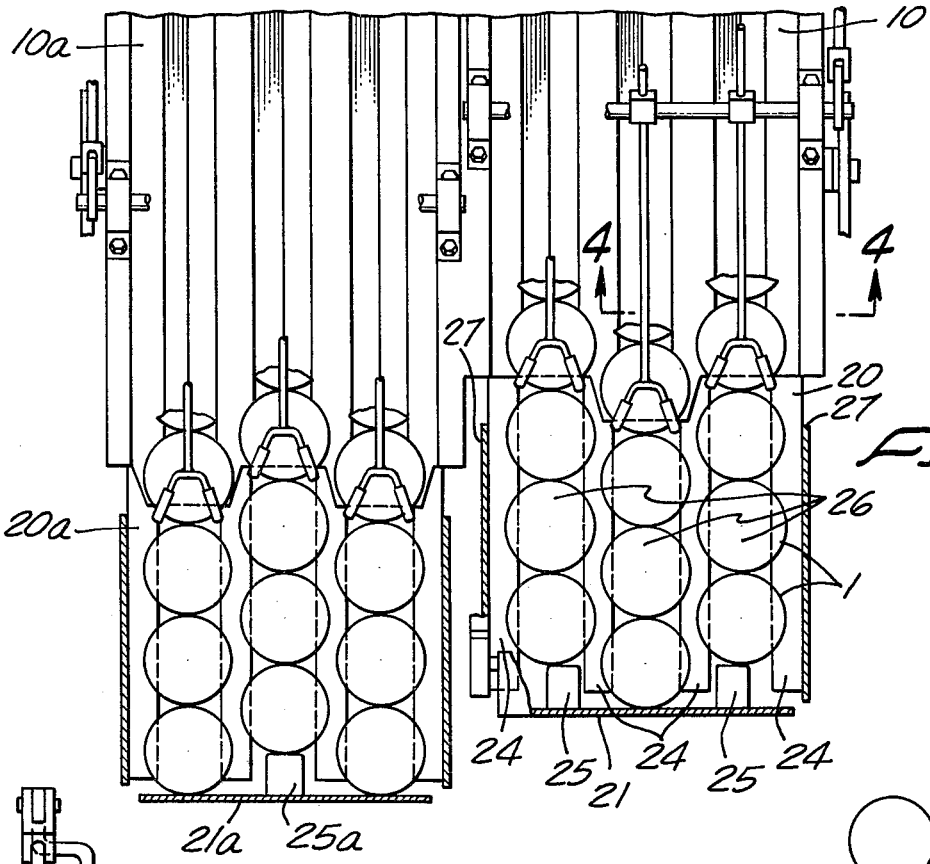
FIG. 3 is a section view, partly broken away, taken substantially on the line 3—3 as shown in FIG. 1.
Figure 4:
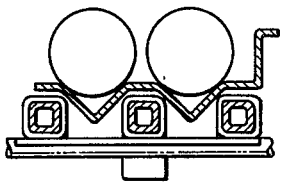
FIG. 4 is a cross-sectional detail taken substantially on line 4—4 as shown in FIG. 3.

Referring to FIG. 3, fruit 1 is arranged on receiving head 20 in a staggered pattern produced by spacers 25 which are attached to gate 21. On the adjacent receiving head 20*a*, fruit is arranged in a complementary staggered pattern by spacer 25*a* on gate 21*a*.

The receiving head 20 comprises a plurality of longitudinal members 24 which are arranged to form spaces 26 which are open at the end of receiving head 20 to which gate 21 is attached. In FIG. 3, there are four longitudinal members 24 arranged so that there are three open ended spaces 26. Articles of fruit 1 rest on longitudinal members 24 in the spaces 26. Side walls 27 are located on the two sides of the receiving head.

Figure 2:
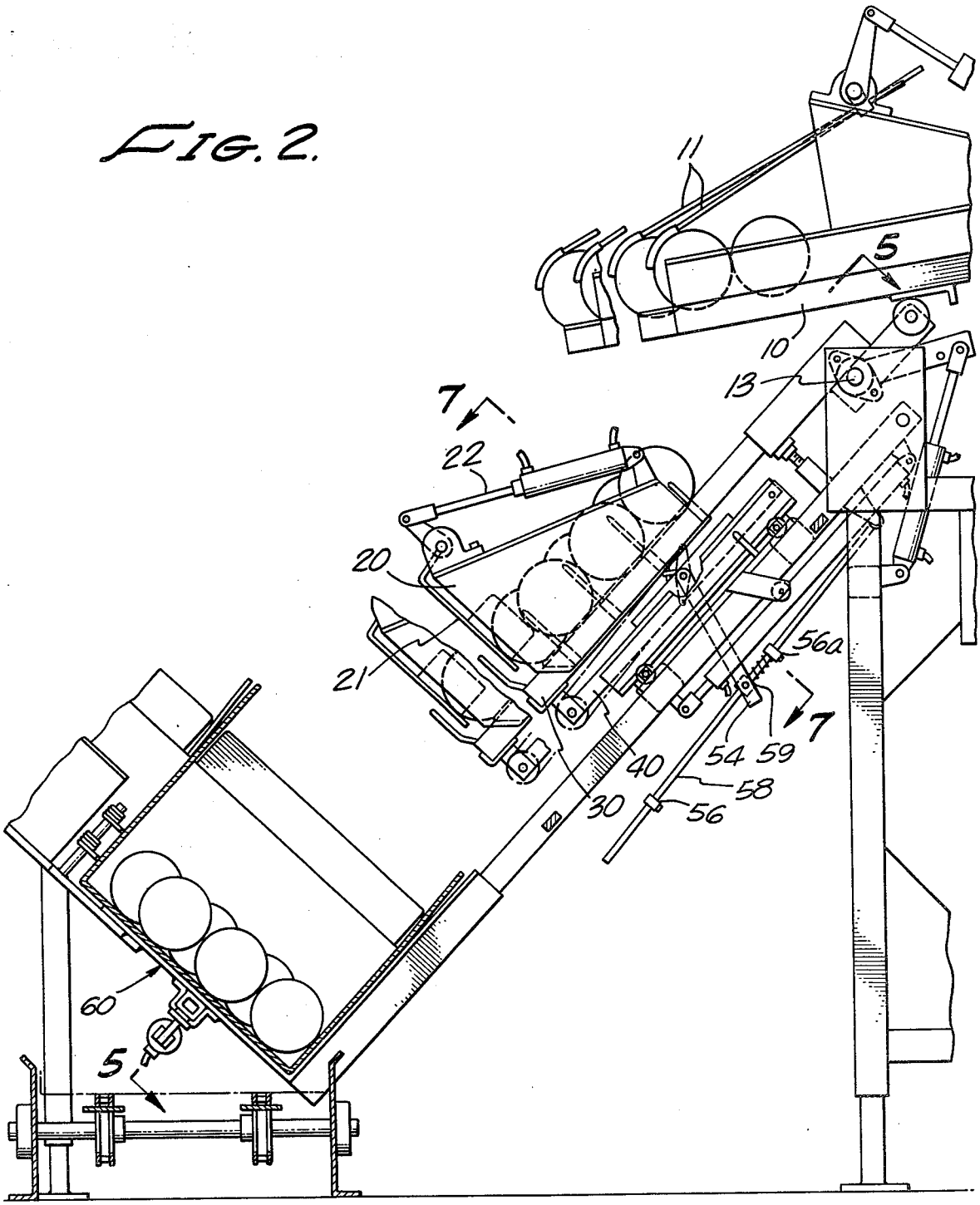
FIG. 2 is a view similar to FIG. 1 showing the receiving head in its downward position in engagement with the transfer rack.

When the receiving head 20 has been filled with fruit, restraining fingers 11 are moved to the down position restraining the fruit 2 on chute 10 to enable the receiving head 20 and the fruit loaded thereon to move downwardly to engage transfer rack 30. In FIG. 2, receiving head 20 is shown in the downward position, having rotated downwardly about pivot 13, and is engaged with transfer rack 30. At this stage of the operation, gate 21 is in the closed position.

Figure 7:
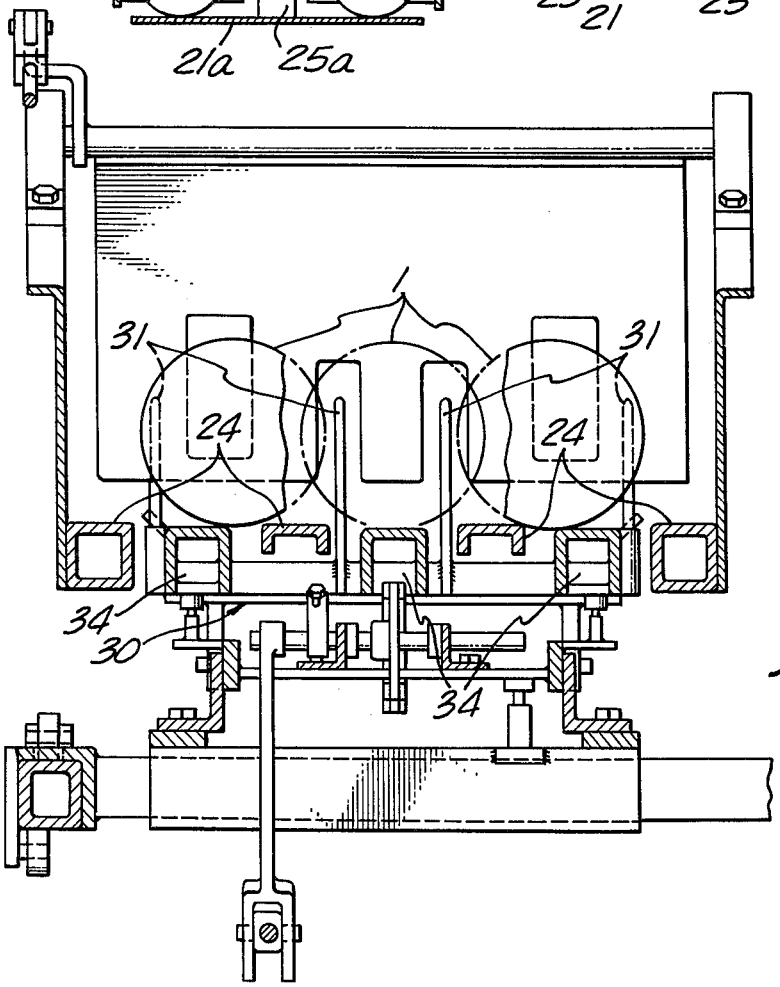
FIG. 7 is a section view taken substantially on the line 7—7 as shown in FIG. 2.
Figure 5:
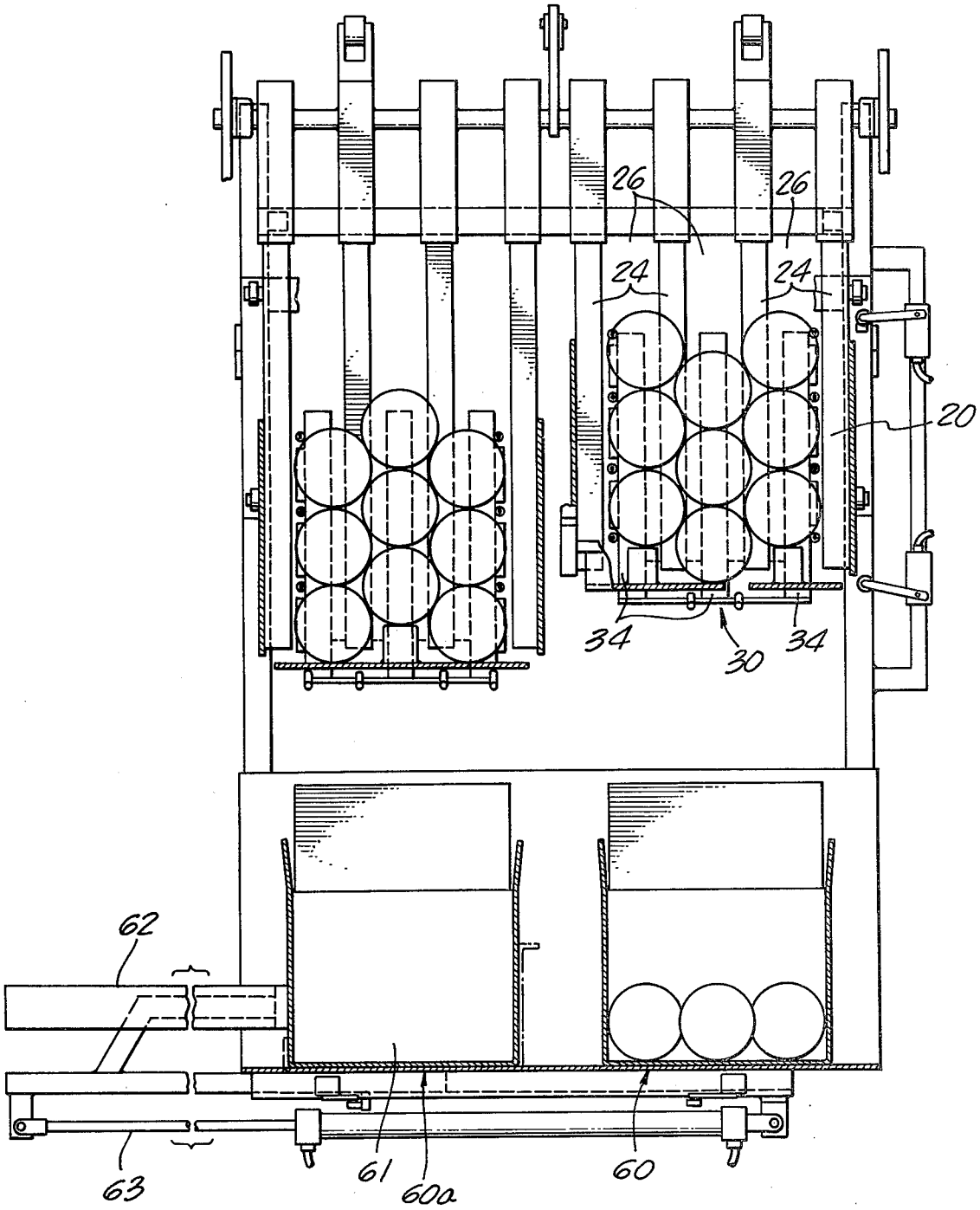
FIG. 5 is a section view taken substantially on line 5—5 as shown in FIG. 2.

The transfer rack 30 has longitudinal members 34 positioned to fit in the spaces 26 of receiving head 20 between longitudinal members 24 of the receiving head 20 when it is moved downwardly to engage the transfer rack. As depicted in FIG. 7, when receiving head 20 is engaged with transfer rack 30, the articles of fruit 1 come in contact with the longitudinal members 34 of transfer rack 30 and are maintained in the pattern in which they were placed on the receiving rack at the perimeter of the transfer rack 30. As depicted in FIG. 7, the restraining means at the perimeter of the transfer rack comprise vertical restraining pins 31. FIG. 5 shows a plan view of restraining head 20 in engagement with transfer rack 30.

Figure 8:
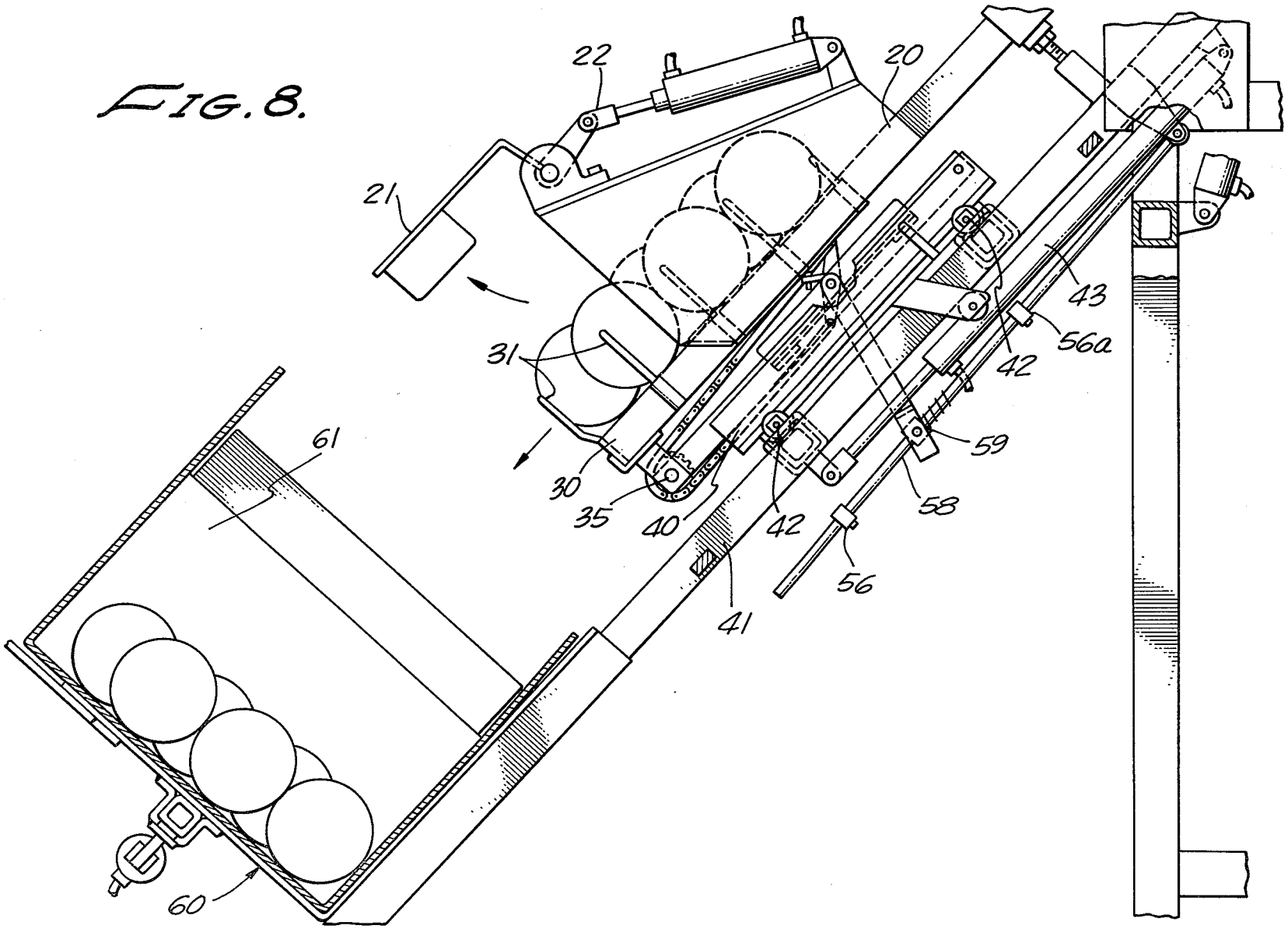
FIG. 8 is a side elevation constituting an enlargement of a portion of FIG. 2, the parts being shown in a different position.

After the articles of fruit 1 have become engaged with transfer rack 30, gate 21 is moved to the open position by cylinder 22 to enable transfer rack 30 and the fruit loaded thereon to move away from receiving head 20. FIG. 8 depicts gate 21 in the open position with transfer rack 30 starting to move out and away from receiving head 20.

Transfer rack 30 is pivotably mounted to carriage 40 at pivot point 35. Carriage 40 is mounted on rails 41. As depicted in FIG. 8, carriage 40 has rollers 42 which enable the carriage and transfer rack 30 mounted thereon to advance along rails 41 away from receiving head 20 in the direction of box loading station 60. Carriage 40 is advanced on rails 41 by actuation means such as the hydraulic cylinder and piston 43 depicted in FIG. 8. After the transfer rack 30 and the fruit loaded thereon has advanced away from receiving head 20, receiving head 20 is returned to its upward position as depicted in FIG. 1.

Figure 9:
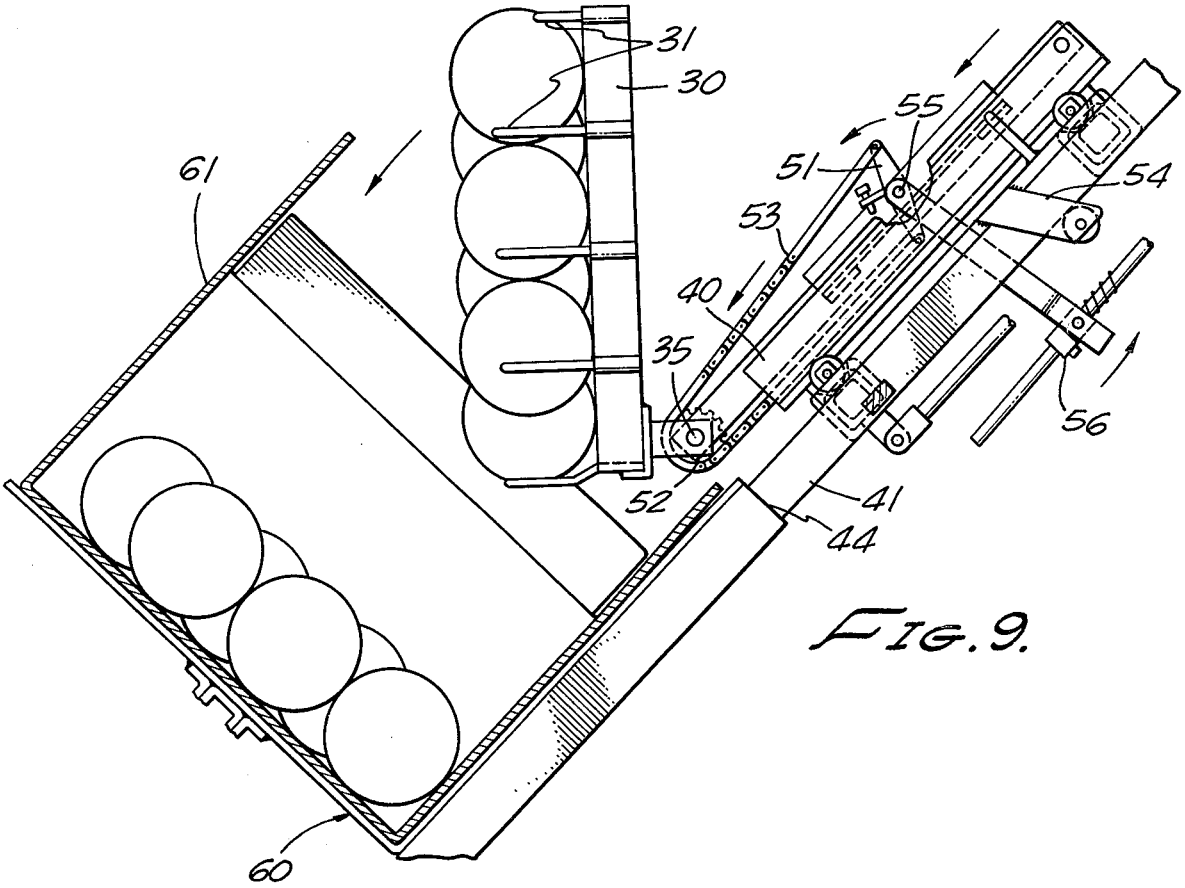
FIG. 9 is similar to a portion of FIG. 8, the parts being shown in a different position.

As carriage 40 moves along rails 41 toward loading station 50 and box 61, transfer rack 30 is pivoted about pivot point 35. This stage of the operation is depicted in FIG. 9. At the point at which the transfer rack 30 is substantially parallel to the base of box 61, and in position to deposit the layer of fruit held on transfer rack 30, motion of the carriage 40 is stopped by the piston and cylinder assembly 43 adjacent the stopping means 44. At this point in the operation, the transfer rack 30 stops its rotation and movement towards the box and the momentum built up in the fruit causes the fruit held on the transfer rack to disengage from the transfer rack and to be deposited into box 61 in the pattern in which it was placed on receiving head 20. This is depicted in FIG. 10.

After the fruit has been deposited from transfer rack 30 into box 61, carriage 40 is returned to its original point by the piston and cylinder assembly 43 to enable the cycle to begin again.

Figure 10:
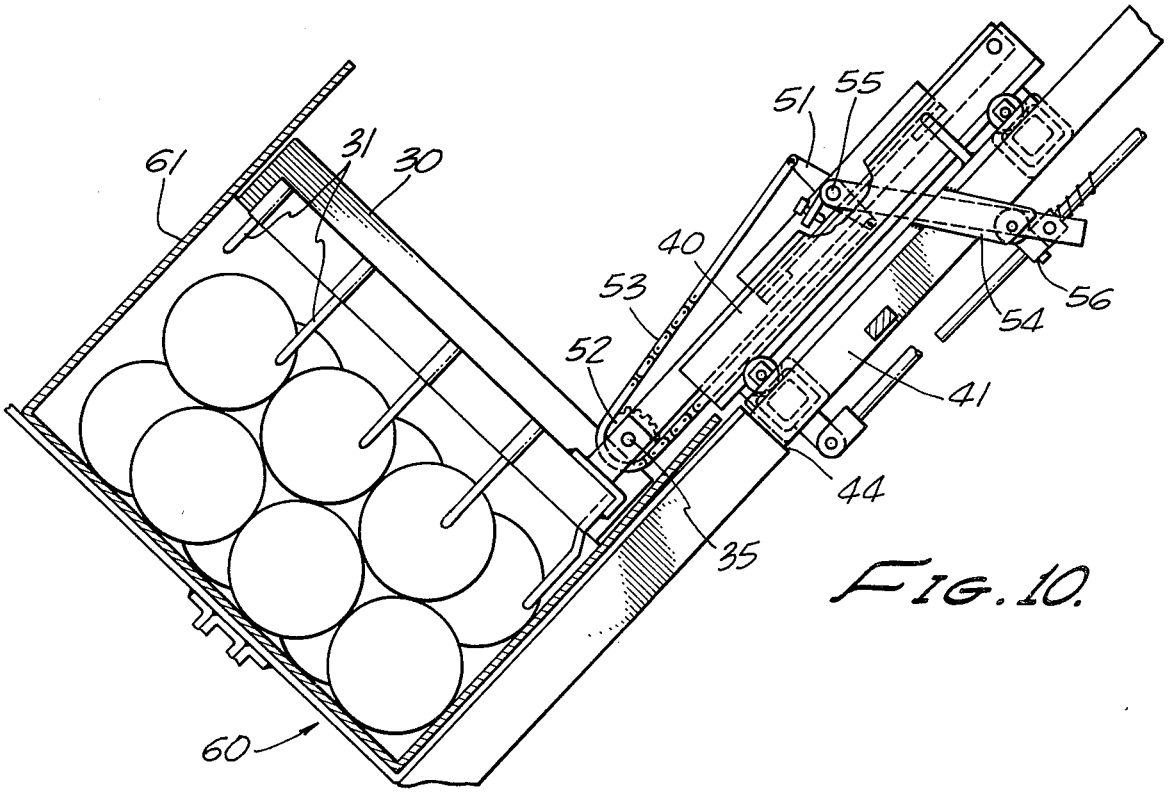
FIG. 10 is similar to FIG. 9, showing the transfer rack depositing fruit into a box.

The mechanism for causing transfer rack 30 to pivot as carriage 40 advances toward and away from loading station 60, is depicted in FIGS. 9 and 10. A first rotational member 51 is pivotably attached to carriage 40 at pivot point 55. A second rotational member 52 is integrally attached to transfer rack 30 at pivot point 35. A chain 53 for transmitting the rotation of first rotational member 51 to second rotational member 52 is engaged with each rotational member. Lever arm 54 is integrally attached to first rotational member 51 and positioned so that as carriage 40 advances along rails 41 toward loading station 60, said lever arm 54 will engage adjustable stop 56 causing the first rotational member 51 to rotate and to transmit rotation to second rotational member 52 which, in turn, causes the transfer rack 30 to pivot. Mechanical elements, such as arms, sprockets or pulleys may be used for rotational members 51 and 52. Devices such as belts or chains may be used for rotation transferring means 53. As depicted in FIGS. 9 and 10, first rotational member 51 is an arm which is pivotably mounted about its center to carriage 40 at pivot point 55. Second rotational member 52 is a sprocket integrally attached to transfer rack 30 at pivot point 35 on carriage 40. The means 53 for transmitting the rotation from the arm 51 to sprocket 52 is a chain 53. Thus, as carriage 40 advances along rails 41 in the direction of loading station 60, lever 54 engages stop 56 and causes arm 51 to rotate in a counter-clockwise direction as depicted in FIG. 9. That rotation is transmitted to sprocket 52 by chain 53 causing transfer rack 30 to pivot in a counter-clockwise direction. At the point at which transfer rack 30 is substantially parallel to the base of box 61, and in position to deposit fruit into the box, carriage 40 is stopped on rails 41 by piston and cylinder assembly 43 as is depicted in FIG. 10. At this point in the operation, the rotational movement of the transfer rack ceases and the momentum which has built up in the fruit causes it to disengage from the transfer rack and be deposited in the box in the pattern in which it was arranged on receiving head 20.

Figure 6:
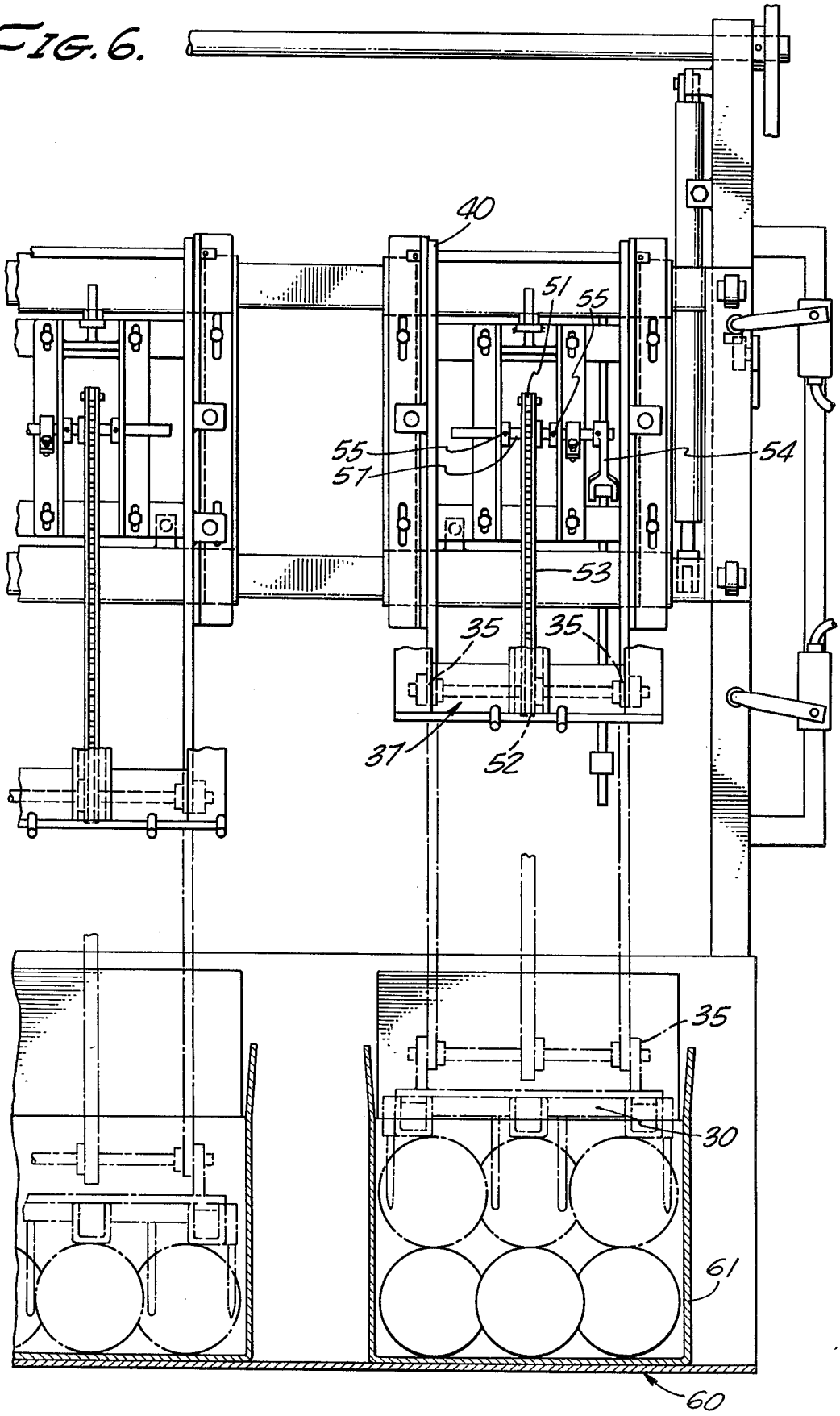
FIG. 6 is an enlargement of a portion of FIG. 5 showing the parts in a different position.

A top view of an embodiment of the pivoting mechanism is shown in FIG. 6. Lever arm 54 is integrally connected to axle 57 which is pivotably mounted on carriage 40 at pivot points 55. Rotational arm 51 is integrally connected to axle 57. Rotational sprocket 52 is integrally connected to axle 37 which is integrally connected to transfer rack 30. Axle 37 is pivotably mounted on carriage 40 at pivot points 35.

After the transfer rack 30 has deposited the layer of fruit into box 61, the carriage returns to its original position. A return stop **56*a*, as shown in FIGS. 1 and 2, actuates the lever arm 54** to return the transfer rack to its original position.

The stop actuation means used to actuate the lever arm may consist of a rod 58 and a block 59 which is pivotably mounted on the lever arm and slidably mounted on rod 58. Block 59 engages stops 56 and **56*a* which are positioned on rod 58** to actuate the lever arm and pivot the transfer rack.

A loading station 60 is provided where open boxes 61 are packed with the fruit from transfer rack 30. An advancing means 62 is provided to advance boxes to and away from the loading station to be packed. As shown in FIG. 5, an empty open box 61 is advanced to the loading station or platform by advancing means 62. The advancing means 62 is actuated by actuation means 63 which is shown in FIG. 5 as a hydraulic cylinder and piston. When the open box 61 is in proper position at loading station 60, the transfer rack 30 pivots into and deposits in the box the layer of fruit in the predetermined pattern.

In FIGS. 9 and 10, the loading station 60 is shown as a platform which is tilted to be at substantially a right angle with the rails 41 on which the transfer rack 30 and carriage 40 travel.

Where the multiple fruit packing units are utilized to pack more than a single layer of fruit in a box, there are accordingly multiple loading stations. As shown in FIG. 5, open box 61 is advanced to loading station **60*a* where a first layer of fruit is loaded by transfer rack 30*a*. That box is then pushed to loading station 60 by the next empty box to be loaded at loading station 60*a* and a second layer of fruit is deposited therein by transfer rack 30**.

To sequence the operations of each element described herein, automatic controls 70 are provided.

Having fully described our invention, it is to be understood that we are not to be limtied to the details herein set forth, but that our invention is of the full scope of the appended claims.

We claim:

1. An apparatus for packing articles of fruit in a predetermined pattern into containers which comprises: a transfer rack adapted to receive articles of fruit from a feed means, a movable carriage on which the transfer rack is pivotally mounted; and an assembly for pivoting said transfer rack to deposit the fruit in a container, said assembly having a first rotational member pivotally mounted to said carriage, a second rotational member fixedly connected to said transfer rack where said rack is pivotally mounted to said carriage, means for causing said first rotational member to rotate when said carriage and transfer rack reach a predetermined position, and means for transmitting the rotation of said first rotational member to said second rotational member for causing said transfer rack to tilt to deposit the articles of fruit in the container.

2. An apparatus for packing articles of fruit in a predetermined pattern into containers as recited in claim 1 in which: the first rotational member is an arm pivotally mounted at its center on the carriage; the second rotational member is a sprocket; the means for causing the first rotational member to rotate is a lever fixedly attached to said first rotational member and actuated by stops; and the means for transmitting rotation is a chain.

3. An apparatus for packing articles of fruit in a predetermined pattern into containers which comprises: a receiving head in which fruit is positioned in said predetermined pattern; means for feeding fruit to the receiving head; a transfer rack disposed below the receiving head; means for moving the receiving head downward so that the fruit may be transferred to the transfer rack in said predetermined pattern, said means also returning the receiving head to its upward position; means for restraining fruit on the feed means when the receiving head is moved downward away from the feed means; a movable carriage on which the transfer rack is pivotally mounted; a movable fruit restraining means on one end of the receiving head for allowing the carriage, transfer rack and fruit supported thereon to advance away from the receiving head; means for advancing the carriage and transfer rack away from the receiving head and for returning it back to its original position; an assembly for pivoting the transfer rack after the carriage and transfer rack have advanced away from the receiving head to deposit the fruit in a container in said predetermined pattern, said assembly having a first rotational member pivotally mounted to the carriage, a lever arm fixedly attached to said first rotational member, means for stopping the lever arm as the carriage and transfer rack move away from the receiving head causing said first rotational member to rotate, a second rotational member fixedly connected to the transfer rack at the point where the transfer rack is pivotally mounted to the carriage, means for transmitting the rotation of the first rotational member to the second rotational member causing the transfer rack to tilt and means for stopping the lever arm as the carriage returns to original position causing the transfer rack to pivot back to downward position; a loading station where containers receive fruit from the transfer rack; and means for advancing containers to and through said loading station.

4. An apparatus for packing articles of fruit in a predetermined pattern into containers as recited in claim 3 in which: the first rotational member is an arm pivotally mounted at its center on the carriage; the second rotational member is a sprocket; and the means for transmitting the rotation of the first rotational member to the second rotational member is a chain in engagement with said sprocket and attached to each end of said arm.

5. An apparatus for packing articles of fruit in a predetermined pattern into containers which comprises: a receiving head on which fruit is positioned in said predetermined pattern, said receiving head having a series of longitudinal members arranged so that said receiving head has spaces between said members, said spaces being open at one end of said receiving head; means for feeding fruit to the receiving head so that articles of fruit rest on said members in the spaces between said members; a transfer rack disposed below the receiving head, said transfer rack having longitudinal members arranged to fit in the spaces of the receiving head when the receiving head is moved downward and engaged with the transfer rack; means for moving the receiving head downward so that the longitudinal members of the transfer rack fit into the spaces of the receiving head and engage the fruit disposed in said spaces, and for returning the receiving head to its upward position; movable fingers for restraining fruit on the feed means when the receiving head is disposed downward away from the feed means; restraining means on the perimeter of the transfer rack to maintain the fruit in the transfer rack in said predetermined pattern; a movable carriage on which the transfer rack is pivotally mounted; a movable gate at the end of the receiving head where said spaces are open-ended to allow the carriage and transfer rack to advance away from the receiving head in the direction of the open end of said spaces; one or more spacers positioned on the inside of said gate to cause the articles of fruit on the receiving head to be disposed in a staggered pattern; rails on which said carriage is slidably mounted so that the transfer rack and carriage may be advanced away from the receiving head in the direction of the open ends of the spaces of the receiving head; actuation means to advance said slidably mounted carriage away from the receiving head and to return said carriage to its original position; an assembly for pivoting the transfer rack after the carriage and transfer rack have advanced away from the receiving head to deposit the fruit in a container in said predetermined pattern, said assembly having a first rotational member pivotally mounted to the carriage, a lever arm fixedly attached to said first rotational member, means for stopping the lever arm as the carriage and transfer rack move away from the receiving head causing said first rotational member to rotate, a second rotational member fixedly connected to the transfer rack at the point where the transfer rack is pivotally mounted to the carriage, means for transmitting the rotation of the first rotational member to the second rotational member causing the transfer rack to tilt, and means for stopping the lever arm as the carriage returns to original position causing the transfer rack to pivot back to downward position; a loading station where containers receive fruit from the transfer rack; and means for advancing said containers to and through said loading station.

6. An apparatus for packing articles of fruit in a predetermined pattern into containers as recited in claim 5 in which: the first rotational member is an arm pivotally mounted at its center on the carriage; the second rotational member is a sprocket; and the means for transmitting the rotation of the first rotational member to the second rotational member is a chain in engagement with said sprocket and attached to each end of said arm.

7. An apparatus for packing a plurality of layers of fruit into containers which comprises a plurality of adjacent fruit packing units each unit having: a transfer rack adapted to receive articles of fruit from a feed means, a movable carriage on which the transfer rack is pivotally mounted; and an assembly for pivoting said transfer rack to deposit the fruit in a container, said assembly having a first rotational member pivotally mounted to said carriage, a second rotational member fixedly connected to said transfer rack where said rack is pivotally mounted to said carriage, means for causing said first rotational member to rotate when said carriage and transfer rack reach a predetermined position, and means for transmitting the rotation of said first rotational member to said second rotational member for causing said rack to tilt to deposit the articles of fruit in the container.

8. An apparatus for packing a plurality of layers of fruit into containers which comprises a plurality of adjacent fruit packing units as recited in claim 7 wherein in each unit: the first rotational member is an arm pivotally mounted at its center on the carriage; the second rotational member is a sprocket; the means for causing the first rotational member to rotate is a lever fixedly attached to said first rotational member and actuated by stops; and the means for transmitting rotation is a chain.

9. An apparatus for packing a plurality of layers of fruit into containers which comprises a plurality of adjacent fruit packing units each unit having: a receiving head in which fruit is positioned in a predetermined pattern; means for feeding fruit to the receiving head; a transfer rack disposed below the receiving head; means for moving the receiving head downward so that the fruit may be transferred to the transfer rack in said predetermined pattern, said means also returning the receiving head to its upward position; means for restraining fruit on the feed means when the receiving head is moved downward away from the feed means; a movable carriage on which the transfer rack is pivotally mounted; a movable fruit restraining means on one end of the receiving head for allowing the carriage, transfer rack and fruit supported thereon to advance away from the receiving head; means for advancing the carriage and transfer rack away from the receiving head and for returning it back to its original position; an assembly for pivoting the transfer rack after the carriage and transfer rack have advanced away from the receiving head to deposit the fruit in a container in said predetermined pattern, said assembly having a first rotational member pivotally mounted to the carriage, a lever arm fixedly attached to said first rotational member, means for stopping the lever arm as the carriage and transfer rack move away from the receiving head causing said first rotational member to rotate, a second rotational member fixedly connected to the transfer rack at the point where the transfer rack is pivotally mounted to the carriage, means for transmitting the rotation of the first rotational member to the second rotational member causing the transfer rack to tilt and means for stopping the lever arm as the carriage returns to original position causing the transfer rack to pivot back to downward position; a loading station where containers receive fruit from the transfer rack; and means for advancing containers to and through said loading station.

10. An apparatus for packing a plurality of layers of fruit into containers which comprises a plurality of adjacent fruit packing units as recited in claim 9 wherein in each unit: the first rotational member is an arm pivotally mounted at its center on the carriage; the second rotational member is a sprocket; and the means for transmitting the rotation of the first rotational member to the second rotational member is a chain in engagement with said sprocket and attached to each end of said arm.

11. An apparatus for packing a plurality of layers of fruit into containers which comprises a plurality of adjacent fruit packing units each unit having: a receiving head on which fruit is positioned in a predetermined pattern, said receiving head having a series of longitudinal members arranged so that said receiving head has spaces between said members, said spaces being open at one end of said receiving head; means for feeding fruit to the receiving head so that articles of fruit rest on said members in the spaces between said members; a transfer rack disposed below the receiving head, said transfer rack having longitudinal members arranged to fit in the spaces of the receiving head when the receiving head is moved downward and engaged with the transfer rack; means for moving the receiving head downward so that the longitudinal members of the transfer rack fit into the spaces of the receiving head and engage the fruit disposed in said spaces, and for returning the receiving head to its upward position; movable fingers for restraining fruit on the feed means when the receiving head is disposed downward away from the feed means; restraining means on the perimeter of the transfer rack to maintain the fruit in the transfer rack in said predetermined pattern; a movable carriage on which the transfer rack is pivotally mounted; a movable gate at the end of the receiving head where said spaces are open-ended to allow the carriage and transfer rack to advance away from the receiving head in the direction of the open end spaces; one or more spacers positioned on the inside of said gate to cause the articles of fruit on the receiving head to be disposed in a staggered pattern; rails on which said carriage is slidably mounted so that the transfer rack and carriage may be advanced away from the receiving head in the direction of the open ends of the spaces of the receiving head; actuation means to advance said slidably mounted carriage away from the receiving head and to return said carriage to its original position; an assembly for pivoting the transfer rack after the carriage and transfer rack have advanced away from the receiving head to deposit the fruit in a container in said predetermined pattern, said assembly having a first rotational member pivotally mounted to the carriage, a lever arm fixedly attached to said first rotational member, means for stopping the lever arm as the carriage and transfer rack move away from the receiving head causing said first rotational member to rotate, a second rotational member fixedly connected to the transfer rack at the point where the transfer rack is pivotally mounted to the carriage, means for transmitting the rotation of the first rotational member to the second rotational member causing the transfer rack to tilt, and means for stopping the lever arm as the carriage returns to original position causing the transfer rack to pivot back to downward position; a loading station where containers receive fruit from the transfer rack; and means for advancing said containers to and through said loading station.

12. An apparatus for packing a plurality of layers of fruit into containers which comprises a plurality of adjacent fruit packing units as recited in claim 11 wherein in each unit: the first rotational member is an arm pivotally mounted at its center of the carriage; the second rotational member is a sprocket; and the means for transmitting the rotational of the first rotational member to the second rotational member is a chain in engagement with said sprocket and attached to each end of said arm.

13. Apparatus for packing objects into containers in a predetermined pattern comprising a receiving head adapted to receive objects from a feed means and to position the objects in a predetermined pattern, a tiltable transfer rack adapted to receive objects from said receiving head in said predetermined pattern, a movable carriage on which said transfer rack is tiltably mounted, and an assembly including first and second pivotable members and connecting means therebetween for tilting said transfer rack to deposit said objects into a container in said predetermined pattern.

14. Apparatus as in claim 13 wherein said movable carriage moves from a first position to a second position, the objects being received by said transfer rack from said receiving head when said movable carriage is in the first position, and said transfer rack being fully tilted to cause the objects to be deposited into the container when said movable carriage is in the second position.

15. Apparatus as in claim 14 wherein said first pivotable member is mounted on said movable carriage and said second pivotable member is connected to said transfer rack whereby rotation of said first pivotable member causes said second pivotable member to pivot and thereby tilt said transfer rack.

16. Apparatus for packing objects into containers in a predetermined pattern comprising, a receiving head adapted to receive objects from a feed means and to position the objects in a predetermined pattern, a transfer rack adapted to receive objects from said receiving head in said predetermined pattern, a movable carriage on which said transfer rack is pivotably mounted, and which moves from a first position to a second position, and an assembly for pivoting said transfer rack including a first pivotable member mounted on said movable carriage, a sprocket connected to said transfer rack and a chain connecting said first pivotable member and said sprocket, whereby rotation of said first pivotable member causes said sprocket to rotate and thereby pivot said transfer rack to deposit the objects into a container in said predetermined pattern, the objects being received by said transfer rack from said receiving head when said movable carriage is in the first position, and said transfer rack being fully pivoted to cause the objects to be deposited into the container when said movable carriage is in the second position.

17. Apparatus for packing objects such as articles of fruit into containers in a predetermined pattern comprising a receiving head including a plurality of longitudinal members for receiving objects and causing those objects to be positioned in a predetermined pattern, a carriage which is movable between a first position and a second position, a transfer rack tiltably mounted on said movable carriage for receiving the objects from the receiving head in said predetermined pattern when said movable carriage is in said first position and for tilting to cause the objects to be deposited into a container in said predetermined pattern when said movable carriage is in said second position, and pivot assembly including first and second pivotable members to cause said transfer rack to tilt when said movable carriage moves to said second position.

* * * * *